United States Patent [19]

Hageman et al.

[11] 4,183,517

[45] Jan. 15, 1980

[54] APPARATUS AND METHOD FOR DELIVERING SIGNATURES TO A GATHERER

[75] Inventors: Carlton V. Hageman; James C. Wise, both of Easton, Pa.

[73] Assignee: Harris Corporation, Cleveland, Ohio

[21] Appl. No.: 864,681

[22] Filed: Dec. 27, 1977

[51] Int. Cl.[2] ..... B65H 1/02; B65H 1/24

[52] U.S. Cl. ..... 271/150; 271/3.1

[58] Field of Search ..... 271/149, 150, 151, 30 A, 271/129, 166, 134, 3.1; 270/54

[56] References Cited

U.S. PATENT DOCUMENTS

| | | | |
|---|---|---|---|
| 1,033,968 | 7/1912 | Waldron | 271/150 X |
| 1,373,187 | 3/1921 | Freeman | 271/30 A |
| 2,163,732 | 6/1939 | Kleineberg et al. | 270/54 |

FOREIGN PATENT DOCUMENTS

| | | | |
|---|---|---|---|
| 2625237 | 2/1977 | Fed. Rep. of Germany | 271/150 |

*Primary Examiner*—Bruce H. Stoner, Jr.

[57] ABSTRACT

An apparatus and method for delivering sheet material, such as signatures, to a gatherer feed mechanism from a vertically stacked on-edge array. A hopper loader delivers signatures to a hopper feed conveyor which moves the signatures in a generally vertically stacked array to a discharge area. Side guides extend above the conveyor to the discharge area. The side guides are spaced apart a distance less than the width of the signatures so that each signature is bowed in the direction of movement of the conveyor. Solenoid-operated pins are provided at the ends of the side guides to alternately hold and release opposite vertical edges of each signature at a predetermined hold-release frequency. The pins maintain the bow and hold the signatures and then release each one to the discharge area in an unbowed condition. Photodetectors maintain the respective pins in the hold position in the event that the delivery area of the hopper becomes full or only one edge of a signature is released.

10 Claims, 3 Drawing Figures

FIG. 2
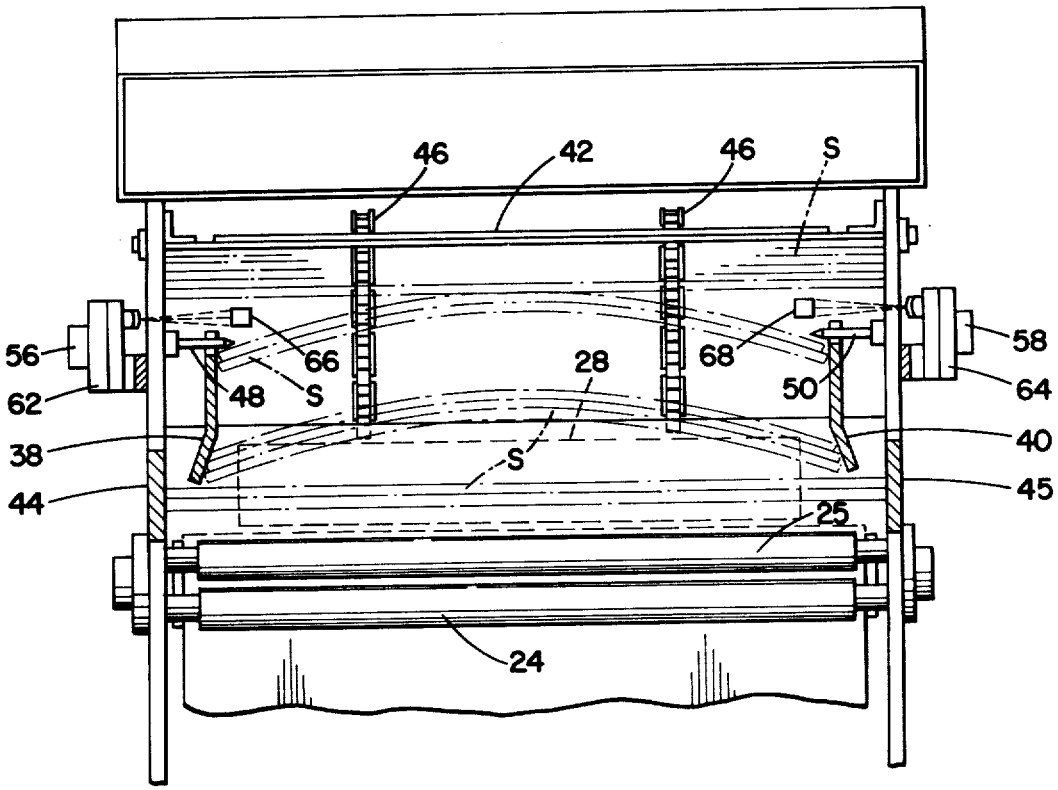
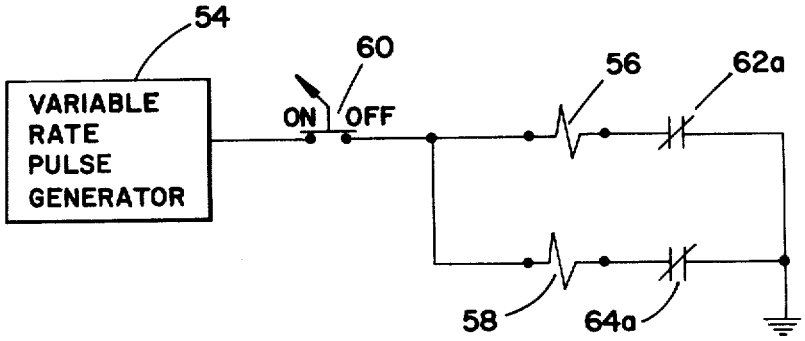
FIG. 3

APPARATUS AND METHOD FOR DELIVERING SIGNATURES TO A GATHERER

BACKGROUND OF THE INVENTION

This invention relates to apparatus and method for delivering signatures to a gatherer feed mechanism in a generally vertically stacked on-edge array. Feed hoppers are commonly provided to feed signatures to a feed drum of an inserter. In hoppers such as that described in U.S. Pat. No. 2,163,732 signatures are conveyed in a vertically stacked or on-edge array to a discharge area of the hopper. The signatures are extracted from the discharge area, opened and dropped on the saddles of a saddle conveyor chain. The signatures are conveyed to the discharge area between side walls which are spaced apart a distance less than the width of a signature so that a bow is formed in the signature by the side wall spacing. The bow assists in providing stability to the on-edge signatures.

Chronic difficulties with vertical feed hoppers such as that described in the aforementioned patent are in maintaining the bow in the signatures and in delivering the signature to the discharge station of the hopper in a controlled manner. For example, signatures tend to become skewed, that is, assume a full width diagonal attitude between the side walls. The skewed signatures are no longer stable and may fall or move into a non-vertical position so that they cannot be extracted correctly at the discharge area. Once the signatures become skewed they will remain in that condition up to the discharge area unless manually restored to the bowed condition. Constant attention must, therefore, be paid to each hopper to ensure that the signatures are properly fed to the discharge area. Since a multiplicity of hoppers are employed in a gathering operation, manual labor costs are significant.

SUMMARY OF THE INVENTION

This invention provides apparatus and method for feeding signatures through a hopper to a gatherer feed mechanism which ensures proper orientation of the signatures in the hopper and proper delivery of the signatures to the feed mechanism. According to the present invention, there is provided a hopper for receiving a generally vertically stacked array of signatures from a hopper loader. A conveyor is provided along the bottom of the hopper to convey signatures to a discharge area for feeding to a gatherer feed mechanism such as that described in U.S. Pat. No. 3,809,384.

As the signatures are fed into the hopper, they are bowed in the direction of movement of the conveyor by side guides which extend in the direction of movement of the conveyor and which are spaced apart a distance less than the width of each signature. The spacing of the side guides terminates at the discharge area so that signatures are collected therein in a flat or unbowed condition.

A pair of oppositely spaced, solenoid-operated pins project into the hopper adjacent the discharge area end of the side guides to engage opposite vertical edges of the endmost signature. The pins maintain the bow in the signatures. Also, the bowed portion of the signatures projects downstream against signatures in the discharge area to assist in retaining those signatures in an upright vertical position. The pins are retracted by their solenoids according to a predetermined hold-release frequency to permit signatures to be individually conveyed to the discharge area in a flat condition. A photodetector detects the presence of a signature edge at each side of the entryway to the discharge area of the hopper. If a signature edge is sensed, the pin adjacent that sensor remains extended to hold a succeeding signature edge against feeding until the preceding signature edge clears the sensing means.

Thus, if the discharge area is full as sensed by the sensors, both pins will remain extended until the signatures clear the sensors. Further, if one edge only of a signature is released and the signatures begin to skew in the hopper, the pin on the side of the hopper containing the released edges will remain extended, since those edges will block the sensor on that side. The sensor on the other side will permit the pin on that other side to operate in its normal fashion so that the lagging edges will be permitted to enter the discharge area.

Apparatus embodying the present invention includes means defining a discharge area for signatures and means for receiving and conveying signatures in a generally vertically stacked array to the discharge area. Side guides extend in the direction of movement of the conveying means and define a storage area for signatures upstream of the discharge area. The side guides are spaced apart a distance less than the width of the signatures so that each signature in the storage area is bowed in the direction of movement of the conveying means. Hold-release means are provided adjacent the end of the storage area to engage opposite sides of each signature to sequentially hold the signature in a bowed condition and release it to the discharge area at a predetermined hold-release frequency.

In a method embodying the present invention a discharge area is provided for discharge of signatures to a gatherer feed mechanism. Signatures are received in a generally vertical on-edge array, a bow is formed on the signatures to provide stability thereto and the signatures are conveyed toward the discharge area. The signatures are then restrained at each side thereof to maintain the bow and prevent passage of the signatures to the discharge area. Periodically, a signature is released and conveyed to the discharge area.

BRIEF DESCRIPTION OF THE DRAWINGS

FIG. 2 is a view of the apparatus on the line 2—2 of FIG. 1; and

FIG. 3 is a schematic diagram of the control circuit for the restrictor pins in the present invention.

DESCRIPTION OF A PREFERRED EMBODIMENT

Figure 1:
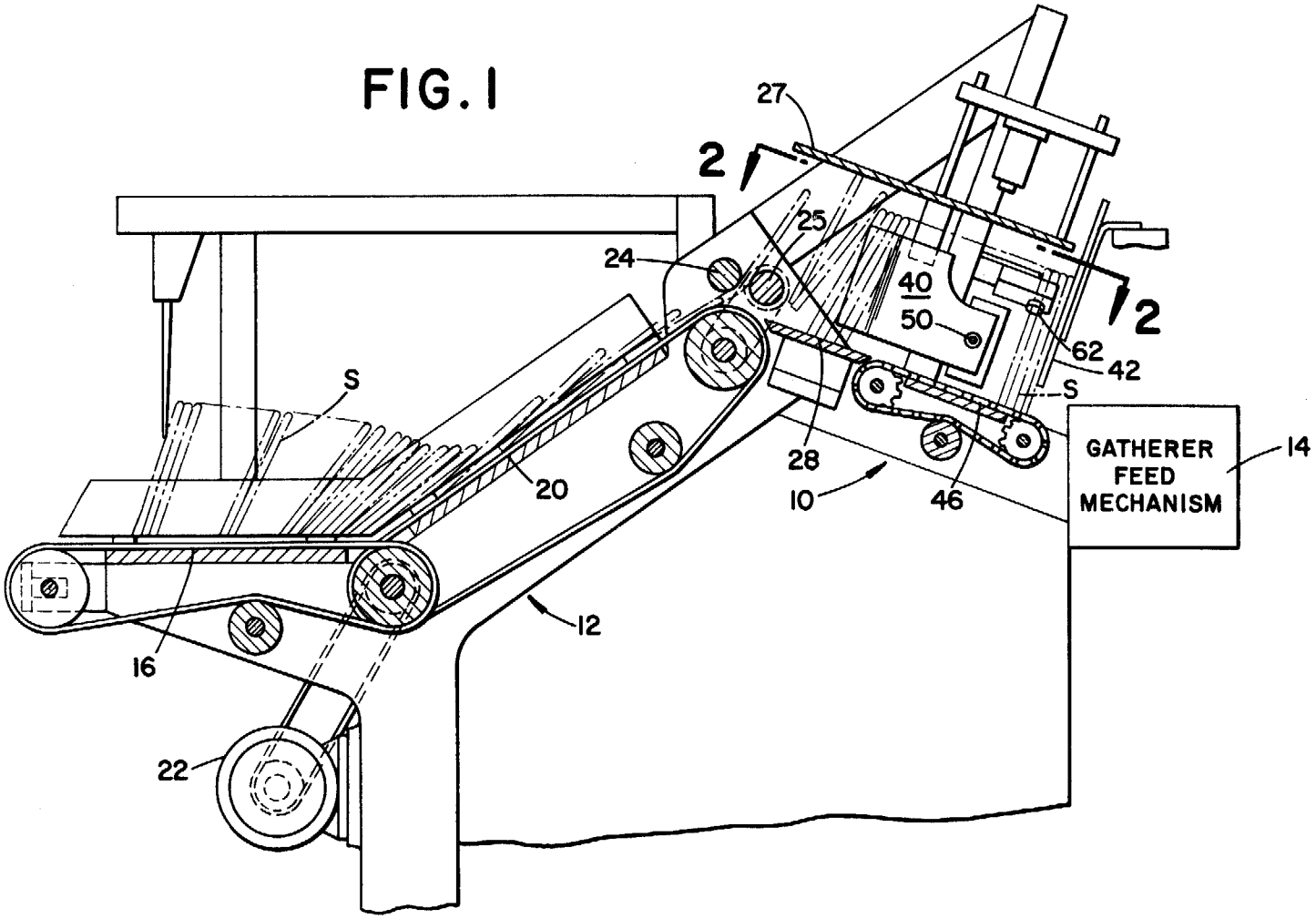
FIG. 1 is a side elevational view of apparatus embodying the present invention.

Referring now to the drawing, there is illustrated in FIG. 1 a hopper 10 which is fed by a hopper loader 12 and which delivers signatures S to a gatherer feed mechanism 14. The gatherer feed mechanism 14 may be of the type disclosed in U.S. Pat. No. 3,809,384.

The hopper loader 12 includes a horizontal in-feed conveyor 16 which advances on-edge signatures toward an inclined conveyor 20 leading to the hopper 10. The conveyors 16 and 20 are driven by a common drive means 22. The signatures S on horizontal conveyor 16 are conveyed in a vertical array to inclined conveyor 20 in the manner disclosed in U.S. Pat. No. 3,904,191. At the entrance to inclined conveyor 20 the signatures are permitted to fall forward. This converts the signatures from the on-edge series to a lapped or shingled stream on conveyor 20. The signatures are then fed to and between a pinch roller 24 and a speeder roller 25 which accelerates and projects each signature upwardly between a stop plate 27 and a jogger table 28.

The signatures S are moved by the reciprocating movements of jogger table 28 and the downward inclination of the jogger table and stop plate 27 between side guides 38 and 40, which are parallel and spaced apart a distance less than the width of a signature in a flat or unbowed condition. The signatures are thus bowed by the side guides and maintained in this condition to promote stability of the signatures in their vertical, on-edge, stacked array.

The signatures are advanced from a storage area of the hopper, which is generally defined by the longitudinal extent of the guides 38 and 40, to a discharge area generally defined as being forward of the guides 38, 40, behind a stop plate 42 and between hopper side frames 44 and 45. The side frames 44, 45 are spaced apart a distance which is generally equal to the width of the signatures in their flat condition.

The signatures S are moved from the storage area to the discharge area by a chain conveyor 46, which extends parallel to the guides 38, 40. As the signatures S are conveyed toward the discharge area, their mid-portions are pulled by the conveyor chains 46 while their vertical edges drag along the guides 38 and 40 until each signature is intermittently retarded by solenoid-operated, extendible and retractible pins 48 and 50 which extend through the guides 38 and 40. Intermittent retraction of the pins 48 and 50 is timed so that individual signatures S are admitted to the discharge area by permitting the pins to release both edges of a signature simultaneously to permit the signatures to flatten out and enter the discharge area. The edges of each succeeding signature are released in sequence to permit those signatures to enter the discharge area. As shown in FIG. 2, the spacing of the pins 48, 50 from the entrance to the discharge area is such that the bow in the signatures S projects toward and assists in supporting the flat signatures in the discharge area.

The sequential pulsing of the pins 48 and 50 is provided by a variable rate pulse generator 54 in the circuit shown in FIG. 3. The pins 48, 50 are normally extended and are retracted for a period and at intervals determined by the selected pulse width and repetition rate of pulses from pulse generator 54. The pulses energize solenoids 56 and 58 to retract pins 48 and 50, respectively, through an on-off switch 60 and contacts **62*a* and 64*a* of photodetector relays 62 and 64. The photodetectors 62 and 64 are mounted at the entrance to the discharge area as shown in FIG. 2. Each detector has its own light source and is aimed at a reflective target 66, 68 supported below the plane of the bottom edge of signatures S and inwardly of side guides 38, 40. The detectors 62, 64** are aimed downwardly and inwardly toward their respective targets.

If the light path between a detector and its target is interrupted by an edge of a signature either when a signature has escaped past a pin 48, 50 or when the discharge area is filled with signatures, the detector will operate its contacts. As is evident from FIG. 3 this will interrupt the energization path of the associated solenoid 56 or 58 and cause the corresponding pin 48, 50 to extend or remain extended. Thus, when the discharge area becomes filled with signatures the light paths to both detectors 62, 64 will be blocked causing the pins 48, 50 to remain extended in a hold condition until the endmost signatures are extracted and conveyor 46 moves the remaining signatures farther into the discharge area and the light paths are unblocked.

As shown in FIG. 3, the photodetectors 62 and 64 independently control their associated pin solenoids 56 and 58. Accordingly, if only one edge of a signature is released during the predetermined hold-release pattern, only one light path will be blocked. If, for example, only the light path to detector 62 is blocked then only pin 48 will be held in an extended position, while pin 50 will continue to operate at its predetermined rate to ensure that the other edge of the signature will be released. This feature prevents the signatures from becoming skewed in the hopper.

Signatures S are extracted from the discharge area by an extractor drum of the gatherer feed mechanism 14 in the manner described in U.S. Pat. No. 3,809,384. The signatures are then opened and deposited upon a saddle by a transfer drum and an opener drum as described in the aforementioned patent.

While the invention has been described in connection with specific embodiments thereof, it is to be clearly understood that this is done only by way of example, and not as a limitation to the scope of the invention as set forth in the appended claims.

What is claimed is:

1. Apparatus for delivering signatures to a feed mechanism, said apparatus comprising means defining a discharge area for signatures from which said signatures are fed by said feed mechanism, means for receiving and conveying signatures in a generally vertically stacked on-edge array to said area, side guide means extending in the direction of movement of said conveying means and defining a storage area for signatures upstream of said discharge area, said side guide means being spaced apart a distance less than the width of each signature so that each signature in said storage area is bowed in the direction of movement of said conveying means, hold-release means adjacent the end of said storage area to engage opposite sides of each signature to sequentially hold the signature in a bowed condition and to release each signature to said discharge area at a predetermined hold-release frequency, and means for operating said hold-release means at said predetermined frequency.

2. Apparatus as claimed in claim 1 further comprising means to override said operating means to prevent release of a signature edge when a corresponding edge of a preceding signature is adjacent the entrance to said discharge area.

3. Apparatus as claimed in claim 2 wherein said means to override said operating means includes signature sensing means on each side of said conveying means between said storage area and said discharge area.

4. Apparatus as claimed in claim 3 wherein each of said signature sensing means is associated with and overrides one of said hold-release means independently of the other hold-release means.

5. Apparatus as claimed in claim 3 wherein said signature sensing means comprises a photodetector relay on each side of said conveyor for detecting an edge of a signature between said storage area and said discharge area.

6. Apparatus as claimed in claim 1 wherein said hold-release means comprises a pair of pins extending into said storage area on opposite sides thereof.

7. Apparatus as claimed in claim 6 wherein said means for operating said hold-release means comprises a solenoid for operating each pin and means for energizing said solenoids at a predetermined frequency.

8. Apparatus as claimed in claim 7 further comprising signature sensing means on each side of said conveyor for sensing an edge of a signature between said storage area and said discharge area, each of said signature sensing means being associated with the one of said pins on the same side of said conveyor and arranged to prevent said pin from releasing further signatures when a signature edge is sensed.

9. A method for delivering signatures to a feed mechanism comprising the steps of providing a discharge area for discharge of signatures to said feed mechanism, receiving signatures in a generally vertical on-edge array at a location spaced from said discharge area, forming a bow in said signatures to provide stability thereto, conveying said bowed signatures on edge toward said discharge area, locating movable members to restrain the side portions of said signatures and to maintain said bow in said signatures, removing said members to release said signatures, conveying a released signature to said discharge area, and repeating said steps of locating and removing said members at a predetermined frequency.

10. A method for delivering signatures to a feed mechanism, said method comprising the steps of providing a discharge area for discharge of signatures to said feed mechanism, receiving signatures in a generally vertical on-edge array at a location spaced from said discharge area, forming a bow in said signatures to provide stability thereto, conveying said signatures toward said discharge area, restraining said signatures at each side thereof to maintain said bow and prevent passage of signatures to said discharge area, periodically releasing said signatures, conveying a released signature to said discharged area, sensing a signature edge at the entrance to said discharge area downstream of said restrained signatures, and preventing the release of said restrained signatures on the side thereof corresponding to said sensed signature edge in response to said sensing.

* * * * *